US006206806B1

(12) United States Patent
Chu

(10) Patent No.: US 6,206,806 B1
(45) Date of Patent: Mar. 27, 2001

(54) ELLIPTICAL MOTION EXERCISER

(76) Inventor: Yong S. Chu, 1225 Raymond Ave., Glendale, CA (US) 91201

( * ) Notice: Subject to any disclaimer, the term of this patent is extended or adjusted under 35 U.S.C. 154(b) by 0 days.

(21) Appl. No.: 09/539,345

(22) Filed: Mar. 31, 2000

(51) Int. Cl.[7] ..... A63B 22/04; A63B 22/00
(52) U.S. Cl. ..... 482/53; 482/51
(58) Field of Search ..... 482/51–53, 57, 482/70, 79, 80

(56) References Cited

U.S. PATENT DOCUMENTS

| | | | |
|---|---|---|---|
| 219,439 | 9/1879 | Blend . | |
| 5,242,343 | 9/1993 | Miller . | |
| 5,290,211 | 3/1994 | Stearns . | |
| 5,383,829 | 1/1995 | Miller . | |
| 5,499,945 | 3/1996 | Habing . | |
| 5,518,473 | 5/1996 | Miller . | |
| 5,529,555 | 6/1996 | Rodgers, Jr. . | |
| 5,549,526 | 8/1996 | Rodgers . | |
| 5,562,574 | 10/1996 | Miller . | |
| 5,577,985 | 11/1996 | Miller . | |
| 5,593,371 | 1/1997 | Rodgers, Jr. . | |
| 5,593,372 | 1/1997 | Rodgers, Jr. . | |
| 5,685,804 | 11/1997 | Whan-Tong et al. . | |
| 5,707,321 * | 1/1998 | Maresh | 482/57 |
| 5,836,855 * | 11/1998 | Eschenbach | 482/57 |
| 5,997,445 * | 12/1999 | Maresh et al. | 482/70 |
| 6,024,676 * | 2/2000 | Eschenbach | 482/51 |

* cited by examiner

*Primary Examiner*—Stephen R. Crow
(74) *Attorney, Agent, or Firm*—Gene Scott-Patent Law & Venture Group

(57) ABSTRACT

An exercise device includes a pair of elongated reciprocating members. The reciprocating members are supported for rotational motion about a pivot axis and the forward ends of the reciprocating members reciprocate back and forth linearly along a motion restrictor forcing near linear motion. The combination of these two motions by the reciprocating members permit a user's feet to travel along conical orelliption motion path of travel. Resistance to rotation of a cranking means is provided and may be selectively altered by the user. At lower inclinations/elevations of the restrictor, the stepping motion may resemble cross-country skiing. At progressively higher angles of inclination or elevations of the restrictor, the stepping motions may simulate walking, jogging, running, climbing.

4 Claims, 4 Drawing Sheets

ELLIPTICAL MOTION EXERCISER

BACKGROUND OF THE INVENTION

1. Field of the Invention

This invention relates generally to exercise machines, and more particularly to an exercise machine producing an elliptical motion emulating a stepping, or climbing motion.

2. Description of Related Art

The following art defines the present state of this field:

Miller, et. al. U.S. Pat. No. 5,242,343 describes an exercise device including a pair of foot engaging links. The first end of each link is supported for rotational motion about a pivot axis and a second end of each foot link is guided in a reciprocal path of travel. The combination of these foot link motions permits the user's foot to travel in an inclined, oval path of travel. This natural foot action exercises a large number of muscles through a wide range of motion.

Rodgers, Jr. et. al. U.S. Pat. No. 5,549,526 describes a stationary exercising device that promotes cardiovascular exercise yet minimizes impact to critical joints, particularly the ankles and knees. A frame supports a linkage assembly having at least one linkage member with a camming surface. The linkage assembly is in turn connected to a coupling system attached to the frame. Structure is included which permits each foot of the user to move the linkage assembly in such a manner as to generate a preferred closed path movement for the foot in a preferred anatomical pattern minimizing unnecessary stress in the joints, yet permitting a cardiovascular workout. Whan-Tong, et al. U.S. Pat. No. 5,685,804 describes an exercise device including a pair of foot engaging links (30*a*, 30*b*). The rearward ends of the foot links are supported for rotational motion about a pivot axis (26), and the forward ends of the foot links reciprocate back and forth along a guide (36). The combination of these two foot link motions permit the user's feet to travel along an elliptical path of travel. The inclination and/or elevation of the guide (36) may be selectively altered to vary the nature of the stepping motion experienced by the user. At lower inclinations/elevations of the guide, the stepping motion may resemble cross-country skiing. At progressively higher angles of inclination or elevations of the guide (36), the stepping motions may simulate walking, jogging, running and climbing. The connection of the foot links to the pivot axis allows motion in a direction orthogonal to the rotational motion, thus compensating for alignment inconsistencies of the device.

Miller, et al. U.S. Pat. No. 5,383,829 describes an exercise device including a pair of foot engaging links. The first end of each link is supported for rotational motion about a pivot axis and a second end of each foot link is guided in a reciprocal path of travel. The combination of these foot link motions permits the user's foot to travel in an inclined, oval path of travel. This natural foot action exercises a large number of muscles through a wide range of motion.

Miller, et. al. U.S. Pat. No. 5,562,574 describes a compact exercise device including a pair of crank arms pivotably supported on a frame for rotation about a pivot axis. Each crank arm engages a respective intermediate link at its first end. A second end of each intermediate link travels on a guide member so that as the crank arms rotates, the first end of each intermediate link traces an arcuate path, and the second end of each intermediate link traces a reciprocating path. The device includes a pair of foot links, each foot link coupled, through a first end thereof, to a respective one of said intermediate links at a point between the first and second ends thereof. A second end of each foot link engages another guide member that directs it along a preselected path of travel, as the intermediate link is moved by the crank arm. The device provides a range of foot and leg motion simulating a natural running and stepping action.

Stearns, et. al. U.S. Pat. No. 5,290,211 describes an exercise device (10) having foot supports (30, 32) on which a user stands for performing a stair stepping exercise alone, or a cross country skiing exercise alone, or simultaneously a stair stepping exercise and a cross country skiing exercise. Linkage support frames (26, 28) each have a first linkage (44) and a second linkage (36) are pivotally connected to each other for maintaining foot supports (30, 32) in a horizontal plane. A fluid cylinder (52) provides a mechanism for resisting the vertical movement of the foot supports (30, 32). Manually gripped poles (60) are mounted to move in coordination with generally horizontal movement of foot supports (30, 32). Separate embodiments of the invention are illustrated in FIGS. 5–13, showing how the invention may be used for performing a stair stepping exercise, a cross-country skiing exercise or walking exercise. An alternative preferred embodiment of the invention that may be folded downwardly for low vertical profile storage is illustrated in FIG. 14.

Miller, et. al. U.S. Pat. No. 5,577,985 describes an exercise device includes a frame having a set of guide links pivotally supported thereupon. Each guide link supports a foot-engaging link at one end thereof. The guide links are reciprocated back and forth by a set of intermediate links that engage a set of cranks that rotate about a second pivot point. A control link joins the foot link to the intermediate link and operates to vary the angle between the guide links and the foot links, as the guide links reciprocate. This device provides a very natural running and stepping action for a user who is positioned on the foot links.

Rodgers, Jr., et. al. U.S. Pat. No. 5,593,372 describes a stationary exercising apparatus which promotes cardiovascular exercise yet minimizes impact on critical joints through the generation of a predetermined elliptical path movement while maintaining foot platforms substantially parallel with the floor. A base structure supports a pair of reciprocating members which are displaced in a horizontal direction parallel with the floor at one end, yet reciprocate in circular motion at the other end through a coupling system attached to the frame. A linkage assembly is included which operates in conjunction with the reciprocation of one end of the reciprocating members to maintain the foot platforms substantially parallel with a reference plane while revolving the foot platforms in a substantially elliptical path. The apparatus may include additional linkage to facilitate a corresponding upper body exercise involving movement of the arms along a predetermined arc.

Rodgers, Jr. et. al. U.S. Pat. No. 5,593,371 describes a stationary exercising device that promotes cardiovascular exercise yet minimizes impact to critical joints, particularly the ankles and knees. A frame supports a linkage assembly having at least one linkage member with a camming surface. The linkage assembly is in turn connected to a coupling system attached to the frame. Structure is included which permits each foot of the user to move the linkage assembly in such a manner as to generate a preferred closed path movement for the foot in a preferred anatomical pattern, minimizing unnecessary stress in the joints yet permitting a cardiovascular workout.

Habing, et al. U.S. Pat. No. 5,499,956 describes an exercise machine having a pair of laterally spaced apart foot pedals, each of which is independently coupled to a frame by a respective articulated linkage. Each such linkage has a generally vertical arm that is pivotally coupled to the frame, and a generally horizontal arm that is pivotally coupled to its respective foot pedal. These arms are pivotally coupled to one another such that each foot pedal is free to move within a twodimensional envelope of motion in a vertical plane. The linkage members are arranged so that the envelope of motion has a generally ovate shape, slightly inclined to the horizontal. The exercises performed with this apparatus may have both vertical and horizontal components of motion. The vertical arms may be interconnected by a crank assembly to relate the horizontal components of motion of the two linkages in an alternating reciprocating fashion.

Rodgers, Jr. et. al. U.S. Pat. No. 5,529,555 describes a crank assembly for use within an exercising device that promotes cardiovascular exercise yet minimizes impact on critical joints, particularly the ankles and knees. The crank assembly employs a dual coupler system that is interconnected for synchronized rotation. Linkage assemblies are provided which define a predetermined path having preferred anatomical pattern for foot movement of the user. The crank assembly can be used in an exercising device that promotes leg exercise primarily, or can be combined with two additional linkage assemblies to provide a combined hand motion with leg movement. In this manner, an enhanced cardiovascular workout is provided which minimizes stress on key joints, particularly the ankles and knees.

Miller et. al. U.S. Pat. No. 5,518,473 describes an exercise device including a frame which supports a pair of foot links, so that a first end of each foot link is pivotably coupled to the frame for motion about an arcuate path. A guide that is supported by the frame engages each foot link, and directs a second end of each foot link along a closed, curved, generally teardrop-shaped path of travel. This combination of motions defined by the foot link provides a natural running and stepping motion in which the heel of a user's foot initially rises faster than the toe as the foot begins to move forward, and subsequently falls faster than the toe as the foot begins to move backward.

Blend, et al. U.S. Pat. No. 219,439 describes the combination of the adjustable brackets and round brackets and roller C D, the crank-shaft E, the pulleys and band F H G, the crank fly-wheels K, the connecting bars L, the cars M, and the tracks formed of the plates N, the bars O, and the switchbars P, with each other and with the framework A B.

The prior art teaches various stationary exercising devices which cause a user's feet to move in circular, elliptical, and backwards and forward movements, and all of which place the cranking means at the front or rear of the device, thereby limiting the diameter of the user's arcuate stride. Although one piece of prior art teaches a pivot point placed medially along a foot pedal, the resulting elliptical path traced by the stride occurs at an inclined angle. However, the prior art does not teach an exercise machine which places the cranking means at the midpoint of the reciprocating members, thereby causing the user to trace a longer elliptical stride than the prior art allows, and hence achieve greater benefits through exercise.

The present invention fulfills these needs and provides further related advantages as described in the following summary.

SUMMARY OF THE INVENTION

The present invention teaches certain benefits in construction and use that give rise to the objectives described below.

The present invention provides an exercise machine with a base portion which rests on a floor; and reciprocating members, or elongated, step-like elements, upon which the feet are placed during exercise. A generally upright post is part of the frame that supports cranks, one on either side of the frame, to which the reciprocating members are attached medially. When the user places his or her feet on the rear portion of the two reciprocating members and applies pressure in a stepping or climbing, motion, the cranks move the reciprocating members in a circular motion about the cranking means. Preferably, the reciprocating members move in opposing directions. As the reciprocating members are moved about the cranking means, the machine also causes the reciprocating members to be thrust in a forward and backwards motion relative to the floor. Both the circular and forward and backward motions of the reciprocating members combine to produce an elliptical motion. While the reciprocating members are tracing their elliptical path, the front ends of these reciprocating members move substantially parallel with the floor.

To increase the physical work required to move the reciprocating members and therefore the effectiveness of the invention, resistance to rotation of the cranking means is provided by a resistance providing means such as a pneumatic tube, which may be selectively altered to vary the nature of the stepping motion experienced by the user. By placing the cranking means at the midpoint of the reciprocating members, the invention causes the exerciser to trace a longer elliptical stride than current exercise machines allow, and hence achieve greater benefits through improved exercise mechanics.

A primary objective of the present invention is to provide an elliptical motion exerciser having advantages not taught by the prior art.

Another objective is to provide such an invention capable of lengthening the major diameter, or elliptical stride a user is required to make, by placing the cranking means at the midpoint or distal end of the reciprocating members.

A further objective is to provide such an invention capable of simulating walking, and climbing motions.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 4:
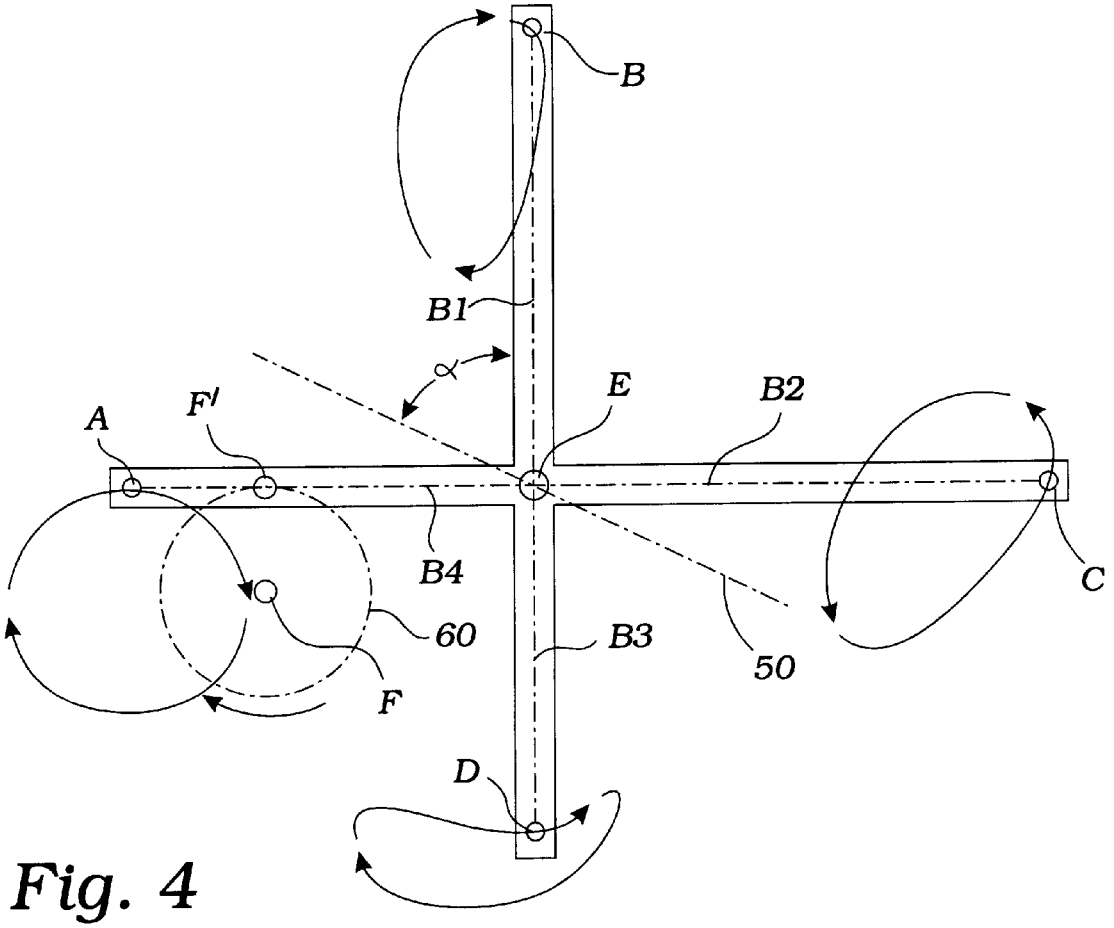
FIG. 4 is a conceptual diagram defining several motions possible using the present invention.

The above-described drawing FIGS. 1–8 illustrate the invention, an exercise apparatus. A conceptual overview of the apparatus is provided by FIG. 4, which shows cranking means 60 defining circular motion about point F. A plurality of conceptually rigid bars B1, B2, B3 and B4 are joined together, and pivotally, to the cranking means 60 at point E. Thus, as cranking means 60 rotates about point F in simple circular motion, link bars B1–B4 move with the cranking means 60 about pivot F'. However, bars B1–B4 are restrained to move along near-linear motion restraining means 50 (shown as a phantom line) as shown in FIG. 4 where point E on link bars B1–B4 is limited to such restrained linear motion. In actuality, near linear motion restraining means 50 may be positioned at any one of a range of angles alpha where alpha has a theoretical range of 360 degrees about point E. Notice that depending upon which link bar B1, B2, B3 or B4 is selected, a different conical motion is achieved as shown by the closed paths defined by points A–D, and defined as pedal, treadmill, stair stepper and bike motions respectively. Please note that a portion of the link bar B4 is included with each of the link bars B1–B3 in order to join points E and F'. Clearly, it should be understood that the diagram of FIG. 4 is drawn to show the several types of motions possible using the present invention and not to infer that all of such motions would be used at the same time.

Figure 1:
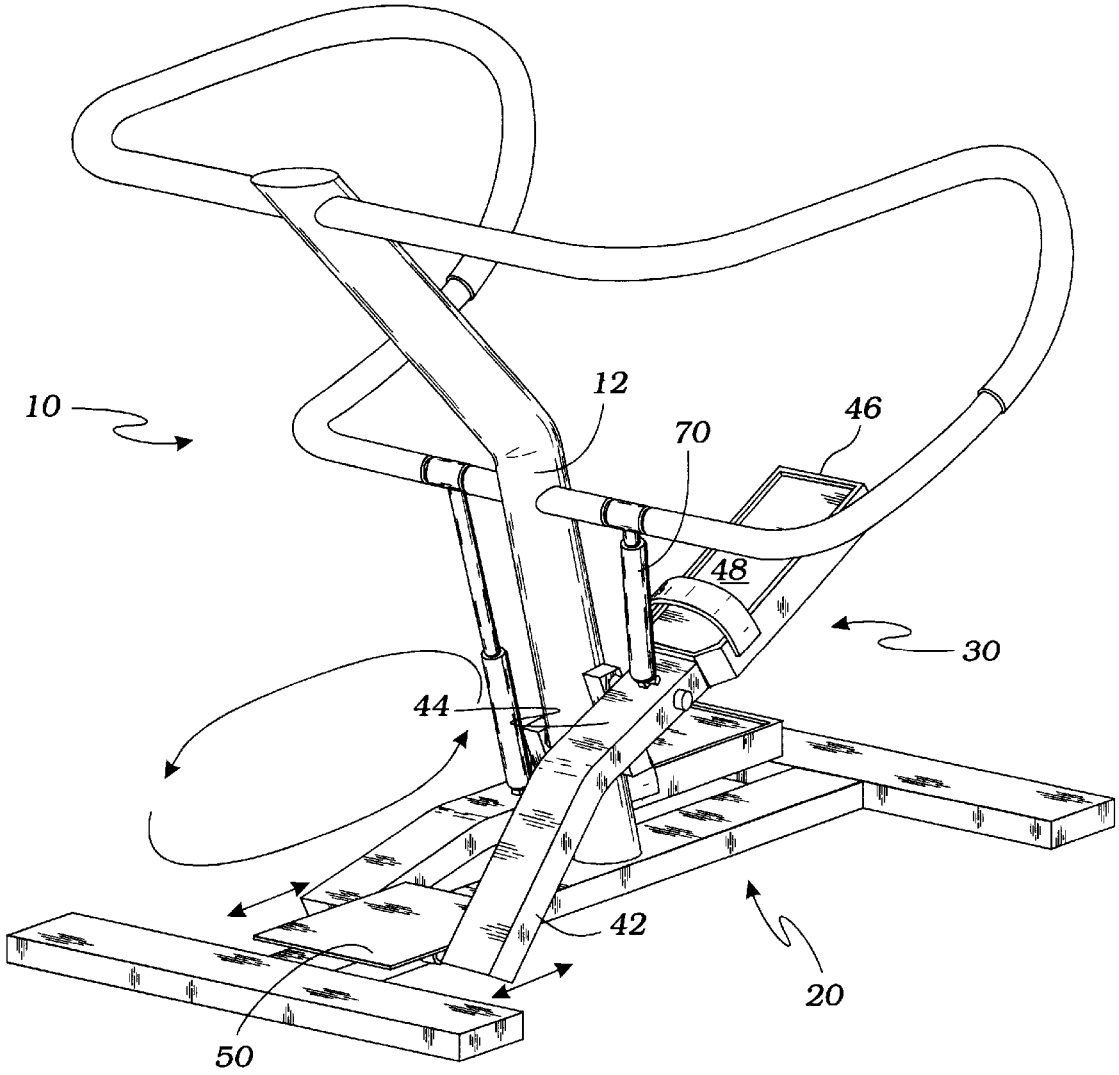
FIGS. 1 and 2 are perspective views of the preferred embodiment of the present invention showing step surfaces at opposing positions.
Figure 2:
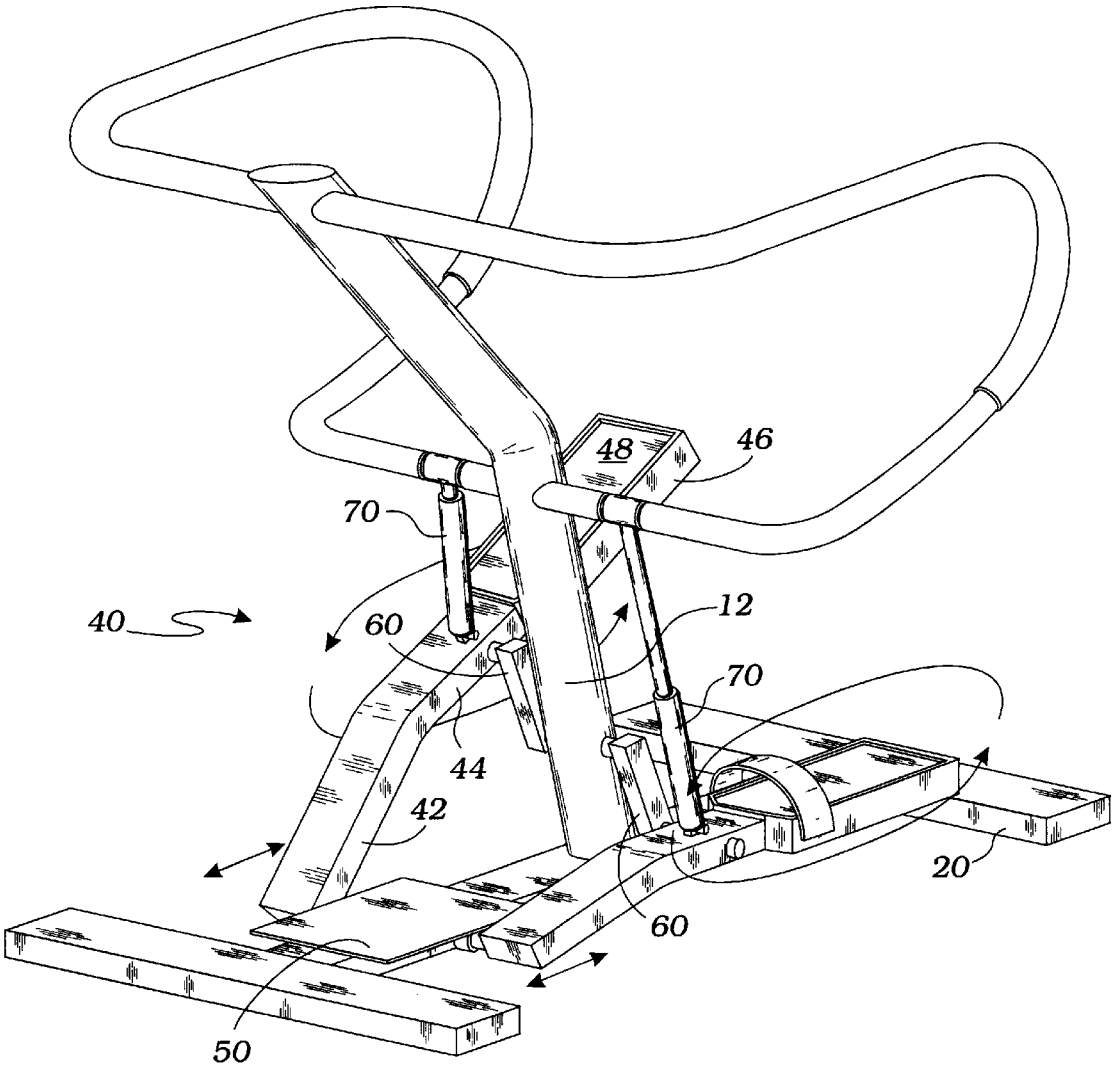
Figure 3:
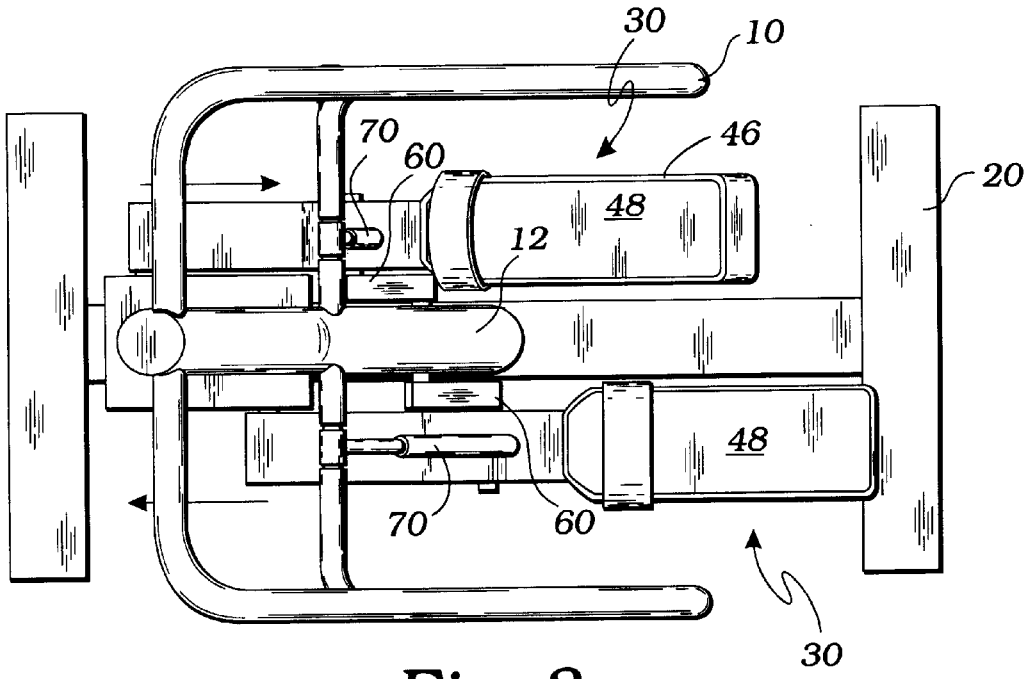
FIG. 3 is a plan view thereof.

As shown in FIGS. 1 and 2, the invention comprises a frame 10 having a base portion 20 adapted by its wide stance and position to be supported by a floor (not shown); and first 30 and second 40 rigid reciprocating members upon which an exerciser stands with one of his/her feet placed on each one of these members 30. Each of the reciprocating members 30, 40 has a distal portion 42, a medial portion 44, and a proximal step portion 46.

In at least one embodiment of the invention, the medial portions 44 of the first and second reciprocating members 30, 40 are joined with a cranking means 60, similar to that of a bicycle, so that they describe circular motion about the cranking means 60. The frame 10 provides a generally upright post 12 supporting the cranking means 60 for rotational motion therein.

Preferably, the cranking means 60 restricts the first reciprocating member 30 to move in opposite phased motion to that of the second reciprocating member 40. The proximal step portion 46 of the reciprocating members 30, 40 provide foot supporting surfaces 48, the foot supporting surfaces 48 describing conical motion as the reciprocating members 30, 40 move with the cranking means 60. A resistance providing means 70 provides resistance to rotation of the cranking means 60, so as to require work for moving the reciprocating members 30, 40. Preferably, the resistance providing means 70 is a pneumatic tube or similar device, and may be joined between the medial portion 44 of each of the reciprocating members 30, 40 and the frame 10. The resistance providing means may also be a flywheel or an electromagnetic rotating machine such as a motor-generator as is well known in the field of this art. In the first embodiment, the distal portions 42 of the reciprocating members are pivotally connected with a motion restrictor 50, thereby tracing near linear motion along the motion restrictor 50; shown as a flat plate attached to the frame 10 in FIGS. 1, 2, 5 and 6. In the conceptual diagram represented by FIG. 4, one of the reciprocating members 30, 40 is represented by link bar B4, and the motion restrictor 50 by a phantom line running through point E.

Inventively, the step portions 46 are placed such that maximum motion excursions thereof, or the maximum extension of an exerciser's step, exceed the circular motion excursion of the cranking means 60, as shown in FIGS. 4, 5, 6, 7, and 8. The apparatus therefore allows an exerciser to extend their limbs beyond the reach of the circular path traced by the cranking means 60, and therefore receive a more complete workout.

Figure 6:
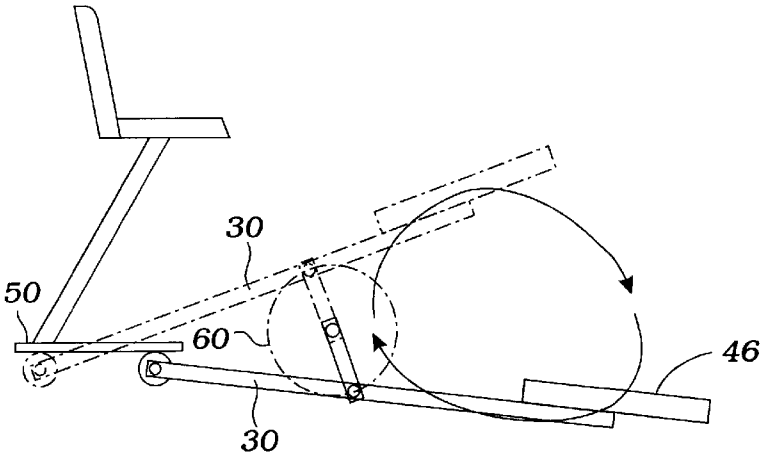
FIGS. 5–8 are schematic diagrams showing the present invention in several alternate configurations.
Figure 5:
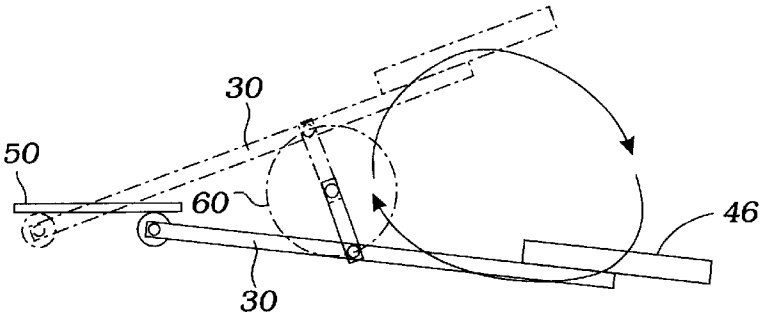

In another series of embodiments, represented by link bars B1–B3 in FIG. 4, and shown schematically in FIGS. 5 and 6, the distal portions 42 of the reciprocating members are adapted for, and constrained to, near linear motion along the motion restrictor 50. The distal portions 42 of the first and second reciprocating members are joined with the cranking means 60, so that they describe circular motion about the cranking means 60. Preferably, again, the cranking means 60 restricts the first reciprocating member 30 to move in opposite phased motion to that of the second reciprocating member 40. The proximal step portion 46 of the reciprocating members 30, 40 provide foot supporting surfaces 48, the foot supporting surfaces 48 describing conical motion as the reciprocating members 30, 40 move with the cranking means 60 as shown in FIG. 1.

Figure 8:
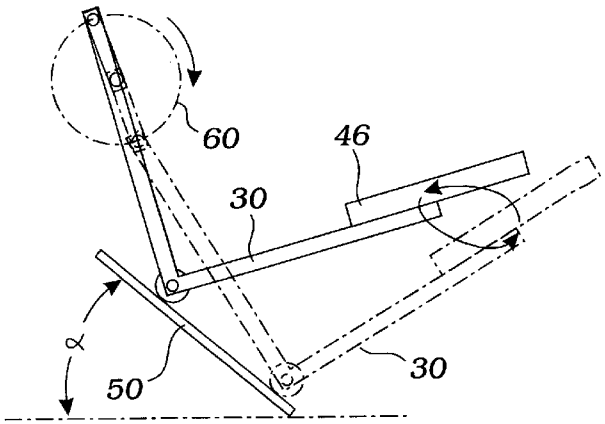
Figure 7:
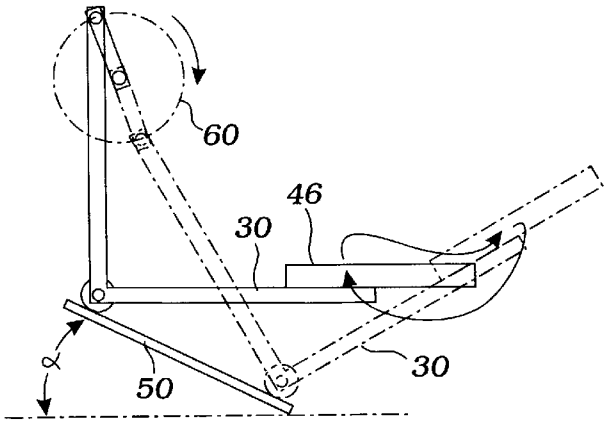

FIGS. 7 and 8 define an alternate embodiment of the present invention wherein the motion restrictor 50 is tilted at a range of angles alpha from the horizontal, where alpha has a theoretical range of between 0 and approximately 80 degrees and the cranking means is at the distal end of the reciprocating member 40. The elliptical motion traced by the proximal step portions 46 varies as the angle alpha increases, as shown.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An exercise apparatus comprising:

a frame having a base portion adapted to be supported by a floor;

first and second rigid reciprocating members, each of the reciprocating members having a distal portion, a medial portion, and a proximal step portion, the medial portion of the first and second reciprocating members adapted for, and constrained to, near linear motion by engagement with a motion restricting means of the frame;

a cranking means supported in rotational motion relative to the frame;

the distal portions of the first and second reciprocating members joined with the cranking means so that said distal portion describe circular motion about the cranking means;

the step portion of the first and second reciprocating members providing foot supporting surfaces, the foot supporting surfaces positioned relative to the medial and distal portions of the reciprocating members so as to describe conical motion as the reciprocating members move with the cranking means;

the step portions placed such that maximum motion excursions thereof exceed the circular motion excursion of the cranking means; and a resisting means engaged with the apparatus for providing resistance to rotation of the reciprocating members so as to require work for moving the first and second reciprocating members.

2. The apparatus of claim 1 wherein the resisting means is joined at the medial portion of each of the first and second reciprocating members.

3. The apparatus of claim 2 wherein the resisting means comprises at least one pneumatic tube.

4. The apparatus of claim 1 wherein the cranking means restricts the first reciprocating member to move in opposite phased motion to that of the second reciprocating member.

* * * * *